US012404785B2

(12) United States Patent
Lorenzon et al.

(10) Patent No.: US 12,404,785 B2
(45) Date of Patent: Sep. 2, 2025

(54) SWITCHING ROCKER ARM HAVING STAMPED INNER ARM CONFIGURATION

(71) Applicant: Eaton Intelligent Power Limited, Dublin (IE)

(72) Inventors: Alessio Lorenzon, Avigliana (IT); Egidio Canzoniere, Matera (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/960,473

(22) Filed: Oct. 5, 2022

(65) Prior Publication Data

US 2023/0024930 A1 Jan. 26, 2023

Related U.S. Application Data

(63) Continuation of application No. PCT/EP2021/025127, filed on Apr. 6, 2021.

(Continued)

(51) Int. Cl.

*F01L 1/18* (2006.01)
*F01L 1/46* (2006.01)
*F01L 13/00* (2006.01)

(52) U.S. Cl.

CPC ..... *F01L 1/18* (2013.01); *F01L 1/462* (2013.01); *F01L 13/0005* (2013.01);

(Continued)

(58) Field of Classification Search

CPC ..... F01L 1/18; F01L 1/462; F01L 13/0005; F01L 2001/186; F01L 2303/00;

(Continued)

(56) References Cited

U.S. PATENT DOCUMENTS 6,439,179 B2 8/2002 Hendriksma et al.
6,532,920 B1 3/2003 Sweetnam et al.

(Continued)

FOREIGN PATENT DOCUMENTS

CN 101660434 A 3/2010
CN 103221645 A 7/2013

(Continued)

OTHER PUBLICATIONS

WO 03/042510, English Language Machine Translation (Year: 2003).*

(Continued)

*Primary Examiner* — Wesley G Harris
(74) *Attorney, Agent, or Firm* — Meunier Carlin & Curfman LLC

(57) ABSTRACT

A switching roller finger follower (SRFF) assembly for valve actuation includes an outer arm and an inner arm pivotally coupled to the outer arm via a pivot axle and at least partially disposed within the outer arm. The inner arm is unitarily formed and has a first inner side arm and a second inner side arm having respective laterally spaced apart longitudinal bends that each define pin apertures. A spring engagement pin extends through the pin apertures, a pair of lost motion springs are supported by the pivot axle, an inner roller is rotatably coupled to the inner arm, and a pair of outer rollers are disposed on respective axles supported by the outer arm.

20 Claims, 7 Drawing Sheets

Related U.S. Application Data

(60) Provisional application No. 63/005,768, filed on Apr. 6, 2020.

(52) U.S. Cl.
CPC ..... *F01L 2001/186* (2013.01); *F01L 2303/00* (2020.05); *F01L 2305/00* (2020.05); *F01L 2305/02* (2020.05)

(58) Field of Classification Search
CPC ... F01L 2305/00; F01L 2305/02; F01L 1/185; F01L 13/0036; F01L 2001/467
USPC ..... 123/90.16, 90.39, 90.44, 90.41
See application file for complete search history.

(56) References Cited

U.S. PATENT DOCUMENTS

| | | | | |
|---|---|---|---|---|
| 8,006,662 | B2 | 8/2011 | Rörig | |
| 10,215,062 | B2 * | 2/2019 | Lia | F01L 13/0005 |
| 2009/0031975 | A1 * | 2/2009 | Rorig | F01L 1/185 123/90.39 |
| 2012/0037107 | A1 * | 2/2012 | Church | F01L 13/0015 123/90.41 |
| 2013/0186358 | A1 | 7/2013 | Manther et al. | |
| 2014/0290608 | A1 * | 10/2014 | Radulescu | F01L 1/46 123/90.39 |
| 2017/0002698 | A1 * | 1/2017 | Cecur | F01L 1/34 |
| 2017/0350282 | A1 | 12/2017 | Suzuki et al. | |
| 2018/0320603 | A1 * | 11/2018 | Vance | F02D 13/0242 |
| 2021/0324770 | A1 * | 10/2021 | McCarthy, Jr. | F01L 1/2405 |
| 2021/0362214 | A1 * | 11/2021 | Halsmer | B21F 5/00 |
| 2022/0228516 | A1 * | 7/2022 | Raimondi | F01L 13/0005 |

FOREIGN PATENT DOCUMENTS

| | | | | |
|---|---|---|---|---|
| CN | 104791034 | A | 7/2015 | |
| CN | 107109969 | A | 8/2017 | |
| CN | 108457713 | A | 8/2018 | |
| CN | 108699926 | A | 10/2018 | |
| DE | 4136143 | A1 * | 5/1993 | F01L 1/185 |
| DE | 10310220 | A1 * | 9/2004 | F01L 1/185 |
| DE | 102006046573 | A1 * | 4/2008 | F01L 1/185 |
| DE | 102017103380 | A1 * | 9/2017 | F01L 1/181 |
| EP | 3118427 | A1 * | 1/2017 | F01L 1/04 |
| WO | WO-03042510 | A1 * | 5/2003 | F01L 1/182 |
| WO | 2017144706 | A1 | 8/2017 | |
| WO | WO-2018068046 | A1 * | 4/2018 | F01L 1/04 |
| WO | WO-2019012432 | A1 * | 1/2019 | F01L 1/053 |
| WO | WO-2022184327 | A1 * | 9/2022 | |

OTHER PUBLICATIONS

Chinese Search Report for CN Application No. 2021800298042 mailed Feb. 27, 2023.
International Search Report and Written Opinion for International Application No. PCT/EP2021/025127 mailed Jul. 22, 2021.

* cited by examiner

SWITCHING ROCKER ARM HAVING STAMPED INNER ARM CONFIGURATION

CROSS-REFERENCE TO RELATED APPLICATIONS

This application is a continuation of International Application No. PCT/EP2021/025127 filed Apr. 6, 2021, which claims the benefit of U.S. Provisional App. No. 63/005,768, filed on Apr. 6, 2020. The disclosure of the above application is incorporated herein by reference.

FIELD

The present disclosure relates generally to switchable rocker arm assemblies and, more specifically, to a switching roller finger follower (SRFF) having a stamped inner arm including longitudinal bends, a stopping feature, and a compact latching design.

BACKGROUND

Switching rocker arms allow for control of valve actuation by alternating between two or more states, usually involving multiple arms, such as in inner arm and outer arm. In some circumstances, these arms engage different cam lobes, such as low-lift lobes, high-lift lobes, and no-lift lobes. Switching rocker arms can be implemented as part of systems commonly referred to as variable valve timing (VVT) or variable valve actuation (VVA) to improve fuel economy, reduce emissions and improve driver comfort over a range of speeds. Mechanisms are required for switching rocker arm modes in a manner suited for operation of internal combustion engines.

Several types of the VVA rocker arm assemblies include an inner rocker arm within an outer rocker arm that are biased together with torsion springs. Switching rocker arms allow for control of valve actuation by alternating between latched and unlatched states. A latch, when in a latched position causes both the inner and outer rocker arms to move as a single unit. When unlatched, the inner and outer arms are allowed to move independent of each other. In some circumstances, these arms can engage different cam lobes, such as low-lift lobes, high-lift lobes, and no-lift lobes. Mechanisms are required for switching rocker arm modes in a manner suited for operation of internal combustion engines.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In one example aspect, a switching roller finger follower (SRFF) assembly for valve actuation is provided. The SRFF assembly includes an outer arm and an inner arm pivotally coupled to the outer arm via a pivot axle and at least partially disposed within the outer arm. The inner arm is unitarily formed and has a first inner side arm and a second inner side arm having respective laterally spaced apart longitudinal bends that each define pin apertures. A spring engagement pin extends through the pin apertures, a pair of lost motion springs are supported by the pivot axle, an inner roller is rotatably coupled to the inner arm, and a pair of outer rollers are disposed on respective axles supported by the outer arm.

In addition to the foregoing, the described SRFF assembly may include one or more of the following features: wherein the respective longitudinal bends are offset from each other by a predetermined distance; wherein the spring engagement pin defines crimped regions thereon; wherein each lost motion spring has a first end that engages the respective crimped regions of the spring engagement pin, the crimped regions reducing contact stress on the respective lost motion springs; wherein the first inner side arm and the second inner side arm each have a bushing aperture to receive a bushing and an inner roller axle; and wherein the inner roller is rotatably coupled to the inner arm by the bushing.

In addition to the foregoing, the described SRFF assembly may include one or more of the following features: wherein the outer arm comprises a stopping feature thereon configured to stop rotation of the inner arm relative to the outer arm; wherein the stopping feature comprises material on the outer arm defining a shoulder to be contacted by the inner arm; wherein the stopping feature comprises a stop pin extending from the outer arm; a latch assembly configured to selectively latch the inner arm to the outer arm to prevent relative movement therebetween; and wherein the latch assembly comprises a latch pin slidingly received within a latch bore formed in the outer arm.

In addition to the foregoing, the described SRFF assembly may include one or more of the following features: wherein the outer arm includes a hydraulic port fluidly coupled to the latch bore; wherein the hydraulic port is configured to selectively receive pressurized fluid from a hydraulic lash adjuster; wherein the latch assembly further comprises a latch cage operably associated with the latch pin; wherein the latch cage is biased away from the latch pin via a biasing member; wherein the latch pin defines a latch cage chamber configured to selectively receive at least a portion of a finger of the latch cage; and wherein the latch cage finger includes a shelf region and wherein the latch cage comprises a flat, wherein the flat is configured to engage the shelf region of the latch cage and inhibit rotation of the latch pin.

In one example aspect, a switching roller finger follower (SRFF) assembly for valve actuation is provided. The SRFF assembly includes an outer arm and an inner arm pivotally coupled to the outer arm via a pivot axle and at least partially disposed within the outer arm. The inner arm is unitarily formed and includes a first inner side arm and a second inner side arm having respective longitudinal bends that each define pin apertures. A spring engagement pin extends through the pin apertures and defines crimped regions thereon. A pair of lost motion springs are supported by the pivot axle and have ends that engage the respective crimped regions of the spring engagement pin, the crimped regions reducing contact stress on the respective lost motion springs. An inner roller is coupled to the inner arm by a bushing, and a pair of outer rollers are disposed on respective axles supported by the outer arm.

In addition to the foregoing, the described SRFF assembly may include one or more of the following features: wherein the respective longitudinal bends are laterally distanced and offset from each other by a predetermined distance; and a latch assembly configured to selectively latch the inner arm to the outer arm to prevent relative movement therebetween, the latch assembly including a latch pin slidingly received within a latch bore formed in the outer arm, the latch pin defining an internal latch cage chamber and a flat, a latch cage having a finger configured to be at least partially received within the latch cage chamber, the finger including a shelf region, wherein the flat is configured to engage the shelf region of the latch cage and inhibit rotation of the latch pin, and a biasing member configured to bias the latch pin away from the latch cage.

DETAILED DESCRIPTION

As will become appreciated from the following discussion, the present disclosure provides a switching roller finger follower (SRFF) assembly with a stamped inner arm having improved longitudinal bends, a stopping feature, and a compact latching design. Longitudinal bends, offset relative to each other so as not to touch are incorporated on an inner arm geometry. A reaction pin used to stop the rotation of the lost motion spring has been moved at one end of the inner arm. In one configuration, the inner arm rotation is stopped using material on the outer arm. In another configuration, a pin is incorporated on the outer arm that is configured to stop inner arm rotation. A new latch pin and cage configuration is also disclosed.

Figure 4:
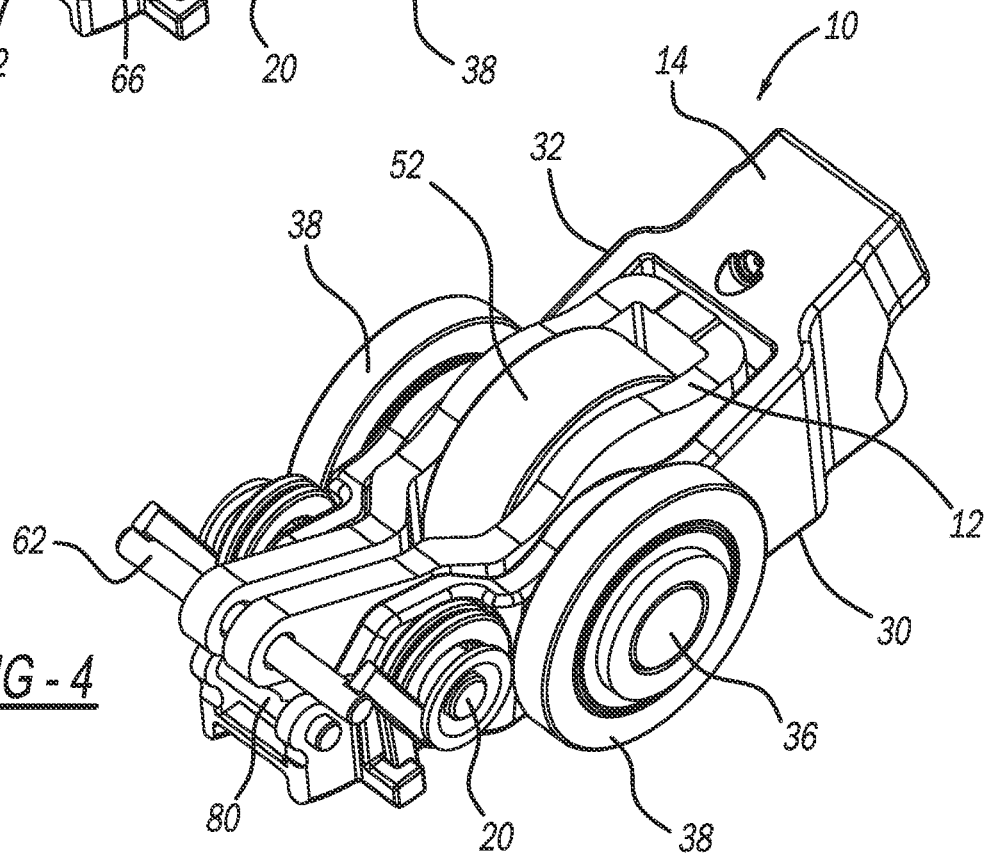
FIG. 4 is a perspective view of an SRFF constructed in accordance to another example of the present disclosure and incorporating a stop pin according to other features.
Figure 5:
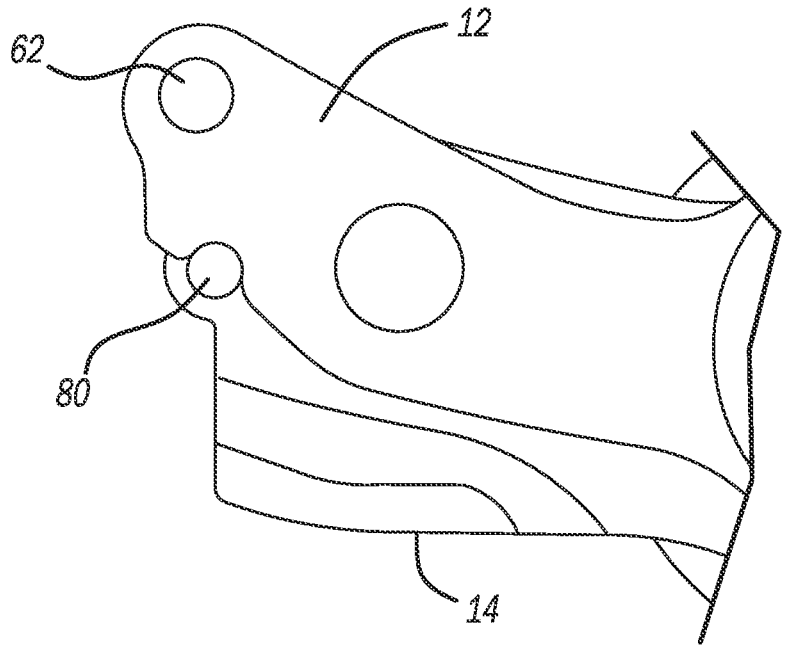
FIG. 5 is a detail view of an exemplary stop pin configured on the outer arm of the SRFF of FIG. 4.

With initial reference to FIGS. 1A-3, a SRFF assembly constructed in accordance to one example of the present disclosure is shown and generally identified at reference numeral 10. FIGS. 4 and 5 illustrate SRFF assembly 10 constructed in accordance to another example of the present disclosure with a different stopping arrangement, as described herein in more detail. Like parts are identified with like reference numerals. In the example embodiments, the SRFF assembly 10 generally includes an inner arm 12 and an outer arm 14. The default configuration is in the normal-lift (latched) position where the inner arm 12 and the outer arm 14 are locked together, causing an engine valve (not shown) to open and allowing the cylinder to operate as it would in a standard valvetrain. When a latch assembly 16 is engaged (e.g., oil from an oil control valve feeds a hydraulic lash adjuster 18, FIG. 9, to engage latch assembly 16), the inner arm 12 and the outer arm 14 operate together like a standard rocker arm to open the engine valve. In the secondary (unlatched) position, the inner arm 12 and the outer arm 14 can move independently to enable the desired secondary function from the SRFF assembly 10.

Figure 1A:
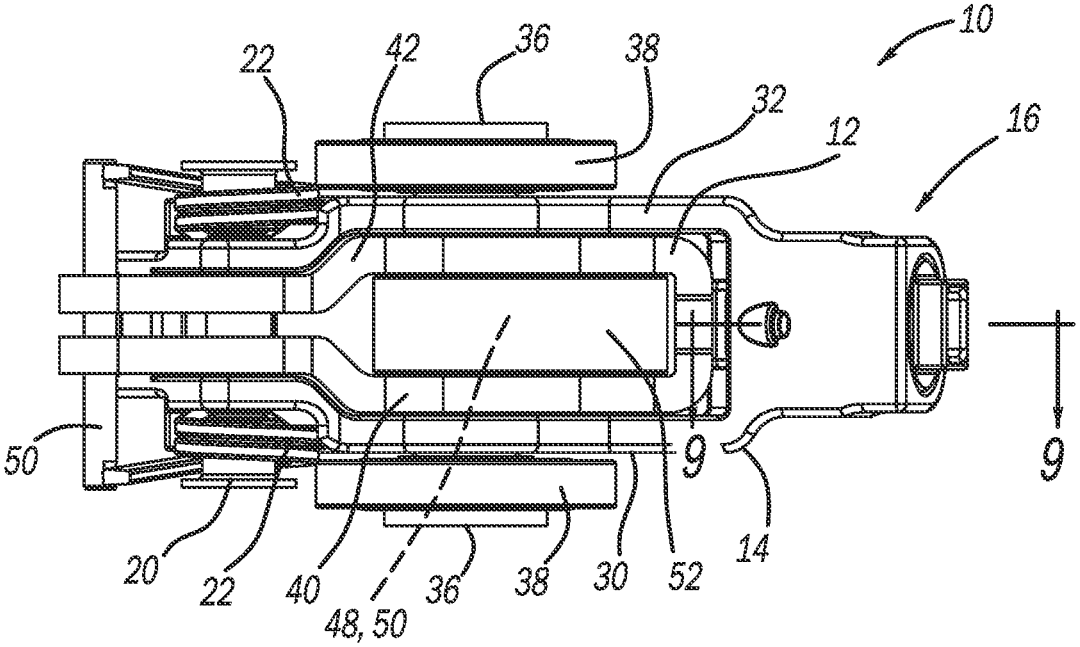
FIG. 1A is a plan view of a switching roller finger follower (SRFF) constructed in accordance to one example of the present disclosure.

In the example embodiment, the inner arm 12 and the outer arm 14 are both mounted to a pivot axle 20, which secures the inner arm 12 to the outer arm 14 while also allowing a rotational degree of freedom pivoting about the pivot axle 20 when the SRFF assembly 10 is in the unlatched state. A pair of lost motion torsion springs 22 are secured to the pivot axle 20 and are configured to bias the position of the inner arm 12 so that it always comes back to the starting position where the related lift can start. As shown in FIG. 1A, the outer arm 14 includes a first outer side arm 30 and a second outer side arm 32. The first and second outer side arms 30, 32 each include an axle 36 that supports an outer roller 38 disposed outboard of each of the first and second outer side arms 30, 32.

With continued reference to FIGS. 1A-5 and additional reference to FIGS. 7 and 8 further features of the inner arm 12 will be described. As shown in FIG. 1A, the inner arm 12 is disposed between the first outer side arm 30 and the second outer side arm 32. The inner arm 12 includes a first inner side arm 40 and a second inner side arm 42 coupled by a connecting member 44. The first and second inner side arms 40, 42 each include an aperture 46 configured to receive a bushing 48 and an axle 50 therethrough. An inner roller 52 is coupled to the inner arm 12, by means of the bushing 48 and axle 50, between the first and second inner side arms 40, 42.

Figure 1B:
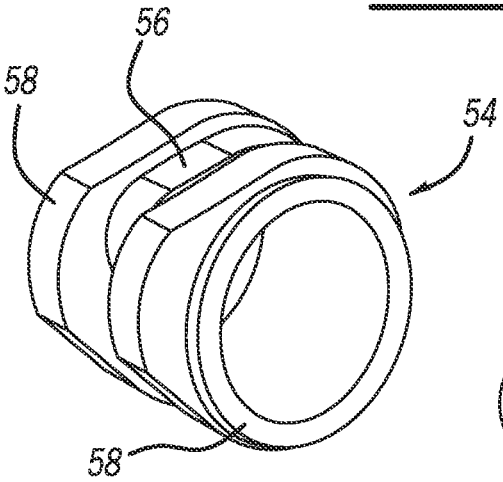
FIG. 1B is an exemplary camshaft lobe configuration for cooperation with the SRFF of FIG. 1A.
Figure 3:
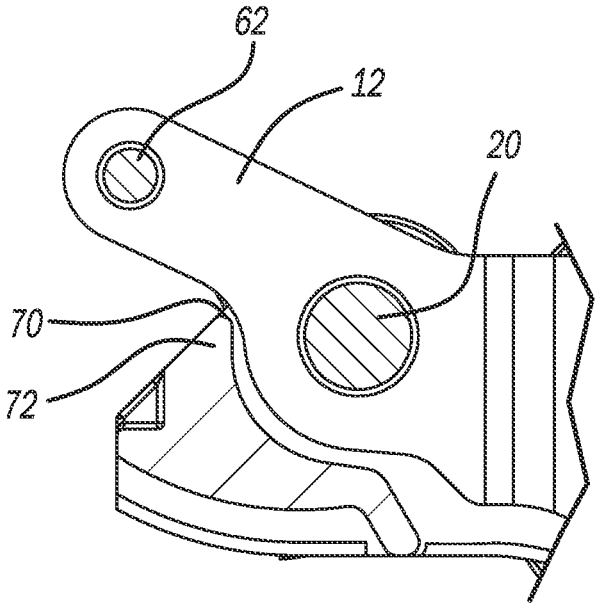
FIG. 3 is a detail view of an exemplary stopping feature configured on the outer arm of the SRFF of FIG. 2.

For exemplary purposes, as shown in FIG. 1B, a cam 54 is configured for cooperation with the SRFF assembly 10. In the illustrated example, the cam 54 includes an inner cam 56 and a pair of outer cams 58. The inner cam 56 is configured to engage the inner roller 52 while the outer cams 58 are configured to engage the outer rollers 38.

Figure 6:
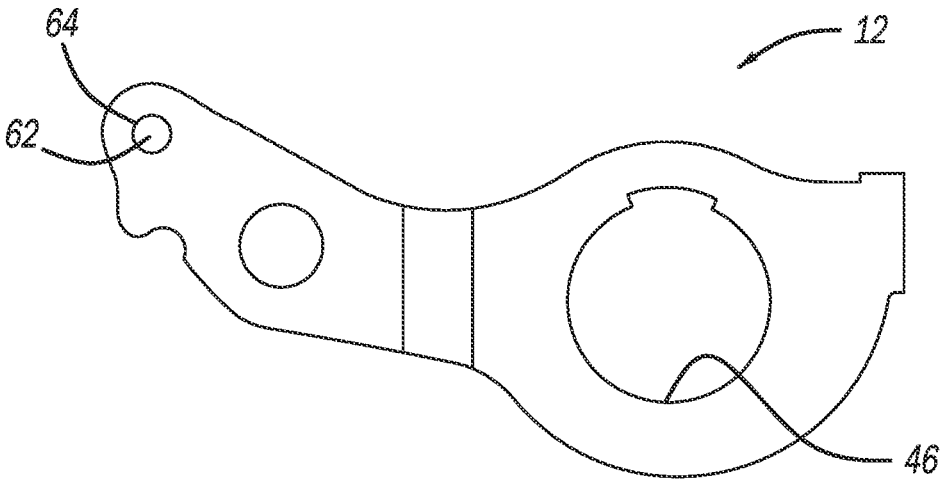
FIG. 6 is a side view of the example inner arm of the SRFF of FIG. 1A.
Figure 7:
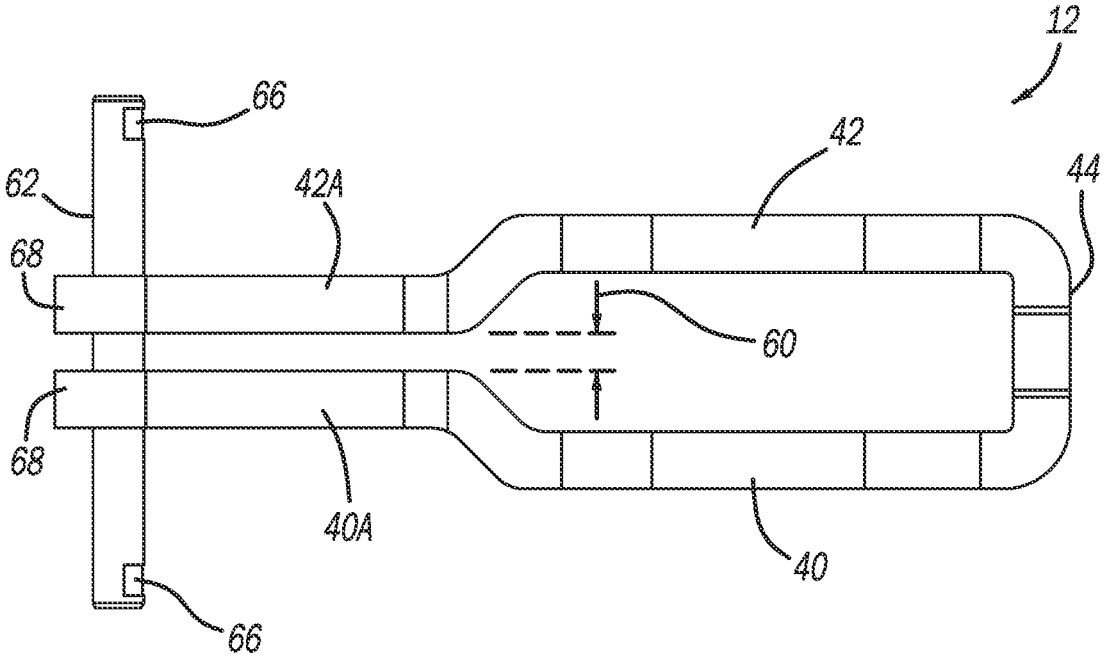
FIG. 7 is a plan view of the inner arm of FIG. 6 shown with a pin extending through pin apertures.
Figure 8:
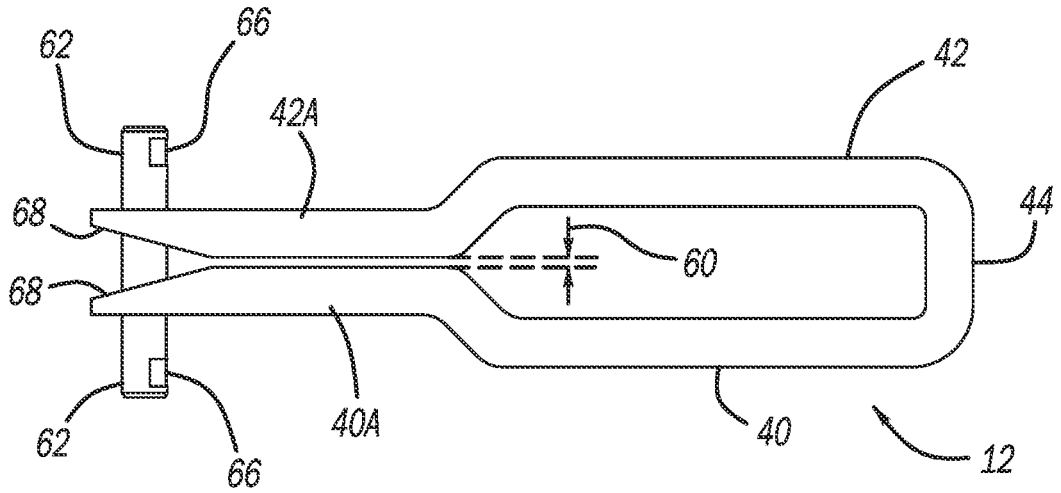
FIG. 8 is a plan view of another inner arm that may be utilized with the SRFF and shown with material removed to accommodate tooling.

With continued reference to FIGS. 6-8, in the example embodiment, the geometry of the stamped inner arm 12 advantageously provides improved stiffness and packaging of the SRFF 10, thereby reducing the overall width in the pad/roller area. Moreover, two additional folding operations are employed to create a geometry of inner arm bends 40A and 42A (FIG. 7) which reduce the width of the inner arm 12 in the valve area. By reducing the width in this area, the lost motion springs 22 can be moved outboard of the outer side arms 30, 32 (see FIG. 1A), thus preserving the packaging and improving the performance of the lost motion springs 22. In particular, the improved packaging allows for increased number of coils and spring diameter in the allotted space.

As illustrated in FIG. 7, in the example implementation, the first inner side arm 40 includes the first longitudinal bend 40A, and the second inner side arm 42 includes the second longitudinal bend 42A. As shown, the first and second longitudinal bends 40A and 42A are laterally spaced or offset and do not touch such that a predetermined distance 60 is defined therebetween. In some examples, the distance 60 is greater than the tooling width. In this regard, coining or other operations may not be required (FIG. 7). In other examples, material from the first and second longitudinal bends 40A, 42A can be removed with coining or other operation (FIG. 8) to ensure enough space for the tooling to crimp a spring engagement pin 62, as described herein in more detail.

With continued reference to FIGS. 2, 4, and 7, additional features of the SRFF assembly 10 will be described. In the example implementation, the spring engagement pin 62 extends through pin apertures 64 defined through the bends 40A and 42A. As shown, the spring engagement pin 62 defines crimped regions 66, which are configured to receive respective lost motion springs 22. The crimped regions 66 advantageously reduce contact stress on the lost motion springs 22. The coining or other operations are used to remove material 68 (FIG. 7) on the inner arm 12 if there is not enough space for the tooling to crimp the spring engagement pin 62. However, those skilled in the art will appreciate that the crimped regions can be provided in any suitable location along the length of the spring engagement pin 62 to accommodate the lost motion spring 22 such as, for example, if the lost motion spring 22 is configured for use inside of the inner arm 12.

Figure 2:
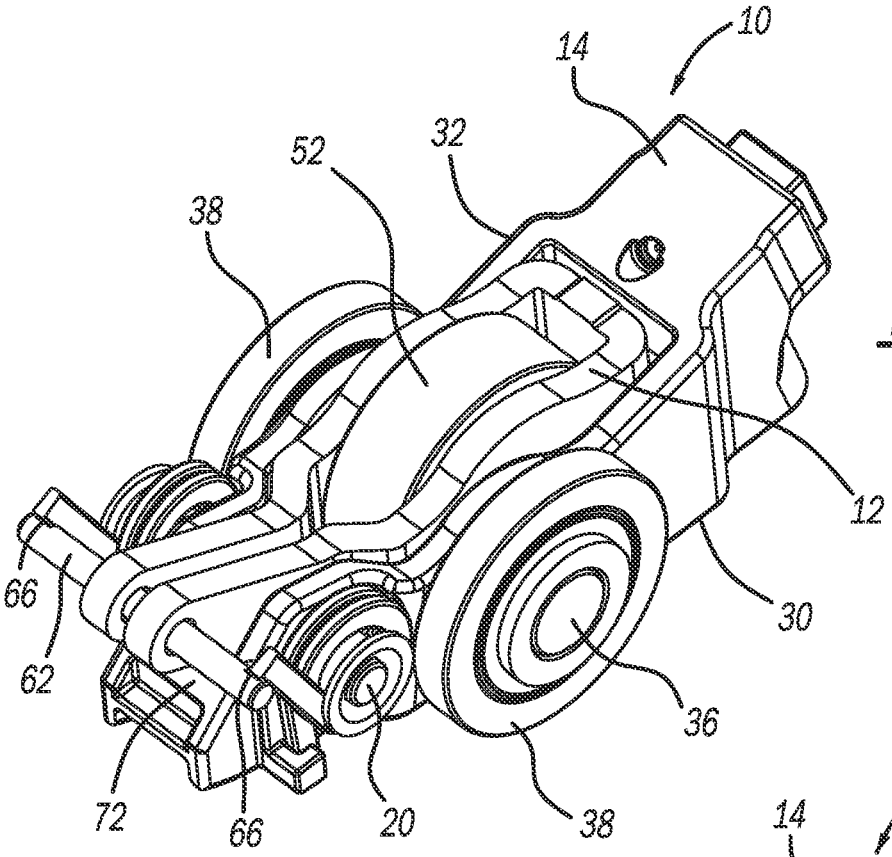
FIG. 2 is a perspective view of the SRFF of FIG. 1A.

With particular reference to FIG. 2, an exemplary stopping feature 70 will be described. In examples where cam lash is not required, a stopping feature 70 can be provided via the material on the outer arm 14 such as, for example a shoulder 72. In this regard, the stopping feature 70 can stop rotation of the inner arm 12 (e.g., counterclockwise in FIG. 2) when the rocker arm 10 is not assembled on the engine. In other examples, shown in FIGS. 4 and 5, if cam lash is required, another stopping feature in the form of a stop pin 80 is assembled on the outer arm 14 to preclude rotation of the inner arm 12. Such stopping features 70, 80 allow the removal of floating axle configurations utilized in prior art systems. In one particular example, replacement of the floating axle configuration with the configuration that includes bushing 48 and axle 50 on the inner arm 12 improves stiffness of the SRFF 10 as a whole and allows for more freedom in the position of the outer rollers 38 with regards to the inner roller 52.

Turning now to FIGS. 9-13, the latch assembly 16 will be described in more detail. In the example embodiment, the latch assembly 16 generally includes a latch pin 100, a latch cage 102, and a latch biasing member 104 (e.g., a spring). The latch pin 100 is slidingly received within a latch bore 106 formed in the outer arm 14 and is configured to move between a deployed latched position (FIG. 9) and a withdrawn unlatched position (not shown). In the latched position, the latch pin 100 is extended to engage the inner arm 12 and prevent rotation relative to the outer arm 14. In the unlatched position, the latch pin 100 is withdrawn into the latch bore 106 and no longer engages the inner arm 12 to allow rotation relative to the outer arm 14.

Figure 9:
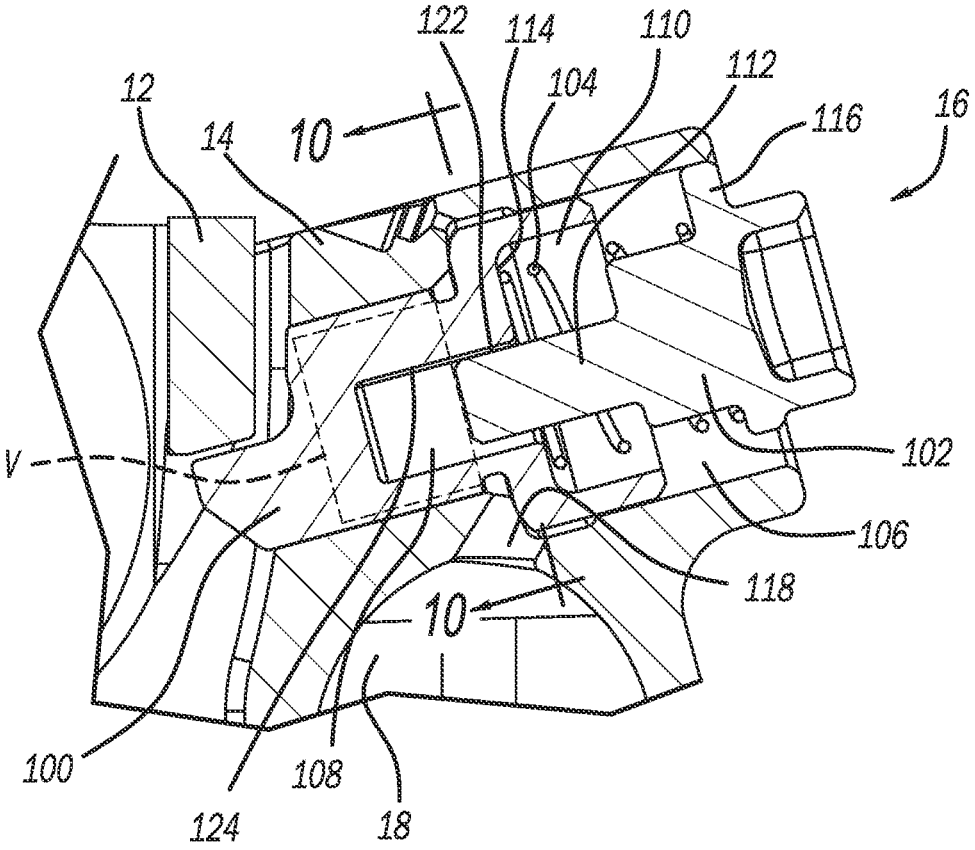
FIG. 9 is a sectional view of the latch assembly taken along lines 9-9 of FIG. 1A.
Figure 10:
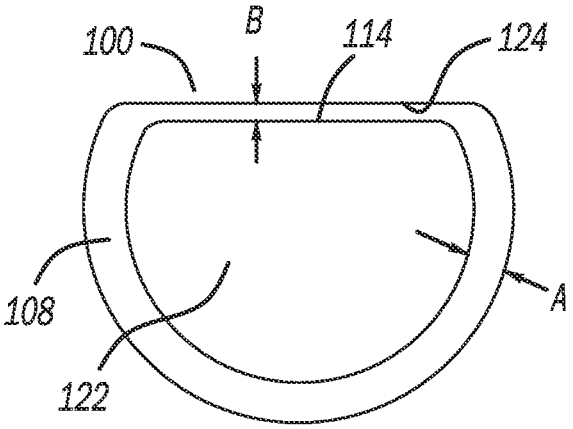
FIG. 10 is a sectional view of the latch assembly taken along lines 10-10 of FIG. 9 and shown with the latch pin engaged and not rotated.

As shown in FIG. 9, the latch pin 100 defines an internal latch cage chamber 108 and outer chamber 110. The latch cage chamber 108 is configured to receive a finger 112 of the latch cage 102, and the outer chamber 110 defines a seat 114 configured to receive one end of the latch biasing member 104. The latch cage 102 includes a flange 116 configured to receive and seat the other end of the latch biasing member 104, which is configured to bias the latch pin 100 away from the latch cage 102 toward the latched position. A hydraulic port 118 (FIG. 9) is configured to receive a pressurized fluid (e.g., oil) from HLA 18 to move the latch pin 100 toward the latch cage 102 to the unlatched position, and the latch cage includes a cutout or window 120 (FIG. 13B) configured to drain oil from the SRFF assembly 10.

Figure 11:
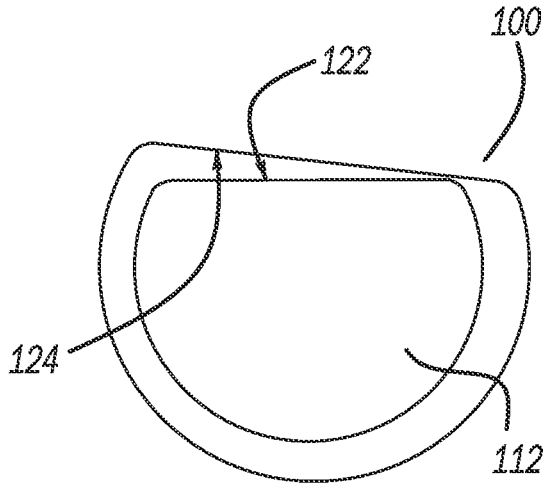
FIG. 11 is a sectional view of the latch assembly of FIG. 10 and shown with the latch pin rotated until a flat on the latch pin engages a shelf region of the latch cage.
Figure 12A:
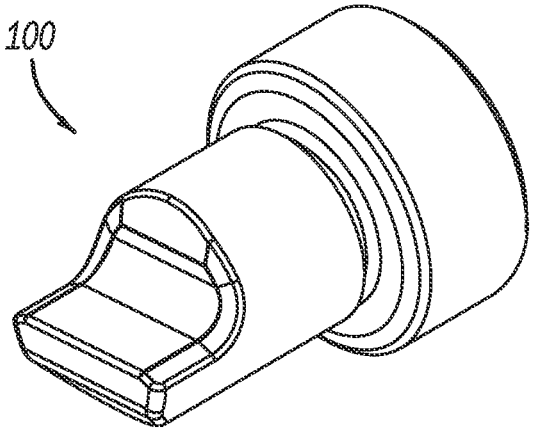
FIG. 12A is front perspective view of the latch pin of the latch assembly shown in FIG. 9.
Figure 12B:
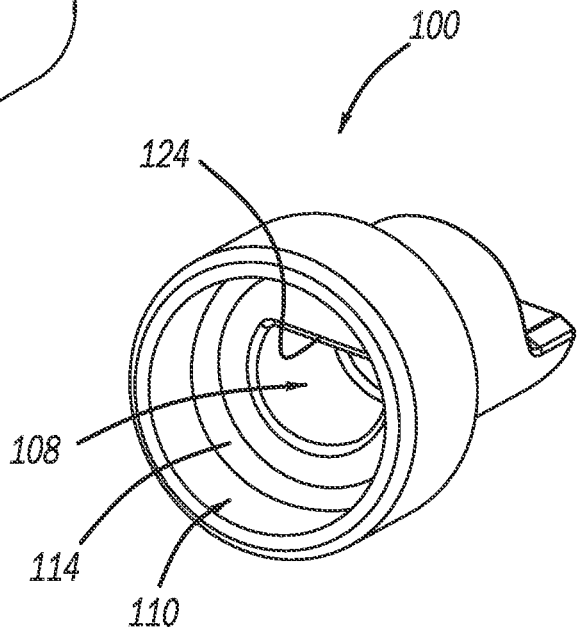
FIG. 12B is a rear perspective view of the latch pin shown in FIG. 12A.
Figure 13A:
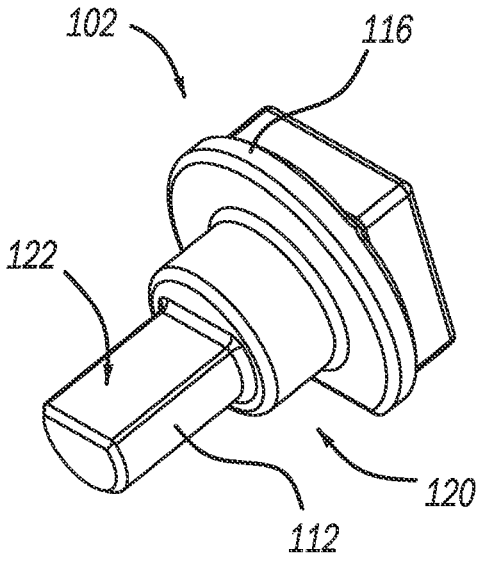
FIG. 13A is a perspective view of the latch cage of the latch assembly shown in FIG. 9.
Figure 13B:
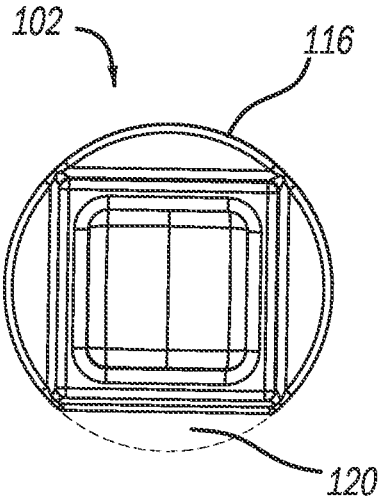
FIG. 13B is an end view of the latch cage shown in FIG. 13A.

In the example embodiment, the latch cage chamber 108 is generally on a volume 'V' (FIG. 9) of the latch pin 100. The finger 112 of the latch cage 102 includes a shelf region 122, and a flat 124 defined on the latch pin 100 in the latch cage chamber 108 is configured to engage the shelf region 122 of the latch cage 102. As shown in FIG. 11, rotation of the latch pin 100 is stopped by engagement between the flat 124 of the latch pin 100 and the shelf region 122 of the latch cage 102. Advantageously, in the example implementation, the diameter of the latch biasing member 104 can be increased, thus reducing the spring rate and improving the performance of the latch biasing member 104.

Described herein are systems and methods for a switching roller finger follower assembly having unique longitudinal inner arm bends and stopping features with a compact latching design. The longitudinal bends are spaced apart and include a reaction pin to limit rotation of the lost motion springs, which are located at ends of the inner arm. Rotation of the inner arm is prevented utilizing material on the outer arm pad or a pin on the outer arm. Moreover, two additional folding operations reduce the width of the inner arm in the valve area. An anti-rotation pin on the inner arm is crimped in the middle to deform the pin in the area where the pin is in contact with the lost motion spring. A shelf on the latch cage is clearance-fit on the latch pin internal chamber, and the shelf region is utilized to stop rotation of the latch pin. The unique geometry of the stamped inner arm advantageously improves stiffness and packaging, avoids contact between the longitudinal bends, and reduces contact stress on the lost motion springs. Further, the latch pin and latch cage design improves packaging to thereby improve latch compression spring performance and response time of the system.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A switching roller finger follower (SRFF) assembly for valve actuation, the SRFF assembly comprising:

an outer arm;

an inner arm pivotally coupled to the outer arm via a pivot axle and at least partially disposed within the outer arm, the inner arm being unitarily formed and having a first inner side arm and a second inner side arm, the first inner side arm and the second inner side arm proximate to a first end of the inner arm being bent toward each other such that a first spacing between the first and second inner side arms proximate to the first end is less than a second spacing between the first and second inner side arms proximate to a second end of the inner arm;

a spring engagement pin extending through pin apertures formed in the first and second inner side arms proximate to the first end of the inner arm;

a pair of lost motion springs supported by the pivot axle;

an inner roller rotatably coupled to the inner arm;

a pair of outer rollers disposed on respective axles supported by the outer arm;

a latch assembly configured to selectively latch the inner arm to the outer arm to prevent relative movement therebetween, wherein the latch assembly comprises a latch pin slidingly received within a latch bore formed in the outer arm, wherein the outer arm includes a hydraulic port fluidly coupled to the latch bore, and wherein said first spacing is defined by respective inner surfaces of the first and second inner side arms being offset from each other by a predetermined distance such that said respective inner surfaces do not contact each other.

2. The SRFF assembly of claim 1, wherein the spring engagement pin defines crimped regions thereon.

3. The SRFF assembly of claim 2, wherein each lost motion spring of the pair of lost motion springs has a first end that engages the respective crimped regions of the spring engagement pin, the crimped regions reducing contact stress on the respective lost motion springs.

4. The SRFF assembly of claim 1, wherein the first inner side arm and the second inner side arm each have a bushing aperture to receive a bushing and an inner roller axle.

5. The SRFF assembly of claim 4, wherein the inner roller is rotatably coupled to the inner arm by the bushing.

6. The SRFF assembly of claim 1, wherein the outer arm comprises a stop thereon configured to stop rotation of the inner arm relative to the outer arm.

7. The SRFF assembly of claim 6, wherein the stop comprises material on the outer arm defining a shoulder to be contacted by the inner arm.

8. The SRFF assembly of claim 6, wherein the stop comprises a stop pin extending from the outer arm.

9. The SRFF assembly of claim 1, wherein the hydraulic port is configured to selectively receive pressurized fluid from a hydraulic lash adjuster.

10. The SRFF assembly of claim 1, wherein the latch assembly further comprises a latch cage operably associated with the latch pin.

11. The SRFF assembly of claim 10, wherein the latch cage is biased away from the latch pin via a spring.

12. The SRFF assembly of claim 10, wherein the latch pin defines a latch cage chamber configured to selectively receive at least a portion of a finger of the latch cage.

13. The SRFF assembly of claim 12, wherein the latch cage finger includes a shelf region and wherein the latch pin comprises a flat, wherein the flat is configured to engage the shelf region of the latch cage and inhibit rotation of the latch pin.

14. A switching roller finger follower (SRFF) assembly for valve actuation, the SRFF assembly comprising:

an outer arm;

an inner arm pivotally coupled to the outer arm via a pivot axle and at least partially disposed within the outer arm, the inner arm being unitarily formed and having a first inner side arm and a second inner side arm, the first inner side arm and the second inner side arm proximate to a first end of the inner arm being bent toward each other such that a first spacing between the first and second inner side arms proximate to the first end is less than a second spacing between the first and second inner side arms proximate to a second end of the inner arm;

a spring engagement pin extending through pin apertures formed in the first and second inner side arms proximate to the first end of the inner arm and defining crimped regions thereon;

a pair of lost motion springs supported by the pivot axle and having ends that engage the respective crimped regions of the spring engagement pin, the crimped regions reducing contact stress on the respective lost motion springs;

an inner roller coupled to the inner arm by a bushing; and a pair of outer rollers disposed on respective axles supported by the outer arm;

a latch assembly configured to selectively latch the inner arm to the outer arm to prevent relative movement therebetween, the latch assembly comprising:

a latch pin slidingly received within a latch bore formed in the outer arm, the latch pin defining an internal latch cage chamber and a flat;

a latch cage having a finger configured to be at least partially received within the latch cage chamber, the finger including a shelf region, wherein the flat is configured to engage the shelf region of the latch cage and inhibit rotation of the latch pin; and a spring configured to bias the latch pin away from the latch cage, wherein said first spacing is defined by respective inner surfaces of the first and second inner side arms being offset from each other by a predetermined distance such that said respective inner surfaces do not contact each other.

15. A switching roller finger follower (SRFF) assembly for valve actuation, the SRFF assembly comprising:

an outer arm;

a unitarily formed inner arm including a first inner side arm defining a first roller portion, a first inner roller aperture formed in the first roller portion, a first arm portion, a first pin aperture formed in the first arm portion, and a first pivot axle aperture formed in the first arm portion between the first pin aperture and the first inner roller aperture, and a second inner side arm defining a second roller portion, a second inner roller aperture formed in the second roller portion, a second arm portion, a second pin aperture formed in the second arm portion, and a second pivot axle aperture formed in the second arm portion between the second pin aperture and the second inner roller aperture, wherein a first distance is defined between the first arm portion and the second arm portion, wherein a second distance, greater than the first distance, is defined between the first roller portion and the second roller portion, and wherein the first arm portion does not contact the second arm portion;

a pivot axle extending through the first pivot axle aperture and the second pivot axle aperture and coupled to the outer arm to pivotably mount the inner arm to the outer arm;

a spring engagement pin extending through the first pin aperture and the second pin aperture;

a pair of lost motion springs supported by the pivot axle and engaged between the outer arm and the spring engagement pin;

an inner roller rotatably coupled to the first inner roller aperture and the second inner roller aperture; and a pair of outer rollers disposed on respective axles supported by the outer arm.

16. The SRFF assembly of claim 15, further comprising a latch assembly configured to selectively latch the inner arm to the outer arm to prevent relative movement therebetween.

17. The SRFF assembly of claim 16, wherein the latch assembly includes a latch pin slidingly received within a latch bore formed in the outer arm, and wherein the outer arm includes a hydraulic port fluidly coupled to the latch bore.

18. The SRFF assembly of claim 17, wherein the latch assembly further includes a latch cage operably associated with the latch pin, wherein the latch cage is biased away from the latch pin via a biasing spring, and wherein the latch pin defines a latch cage chamber configured to selectively receive at least a portion of a finger of the latch cage.

19. The SRFF assembly of claim 15, wherein the first inner side arm defines a first longitudinal bend between the first roller portion and the first arm portion, and wherein the second inner side arm defines a second longitudinal bend between the second roller portion and the second arm portion.

20. The SRFF assembly of claim 15, wherein the pair of lost motion springs are positioned outboard of the outer arm.

* * * * *